US005314310A

United States Patent [19]

Bachellier

[11] Patent Number: 5,314,310

[45] **Date of Patent: * May 24, 1994**

[54] SPIDER MOUNTED CENTRIFUGAL MIXING IMPELLER

[76] Inventor: Carl R. Bachellier, 10 Watsons Lane, Dundas, Ontario, Canada, L9H 1T3

[ * ] Notice: The portion of the term of this patent subsequent to Aug. 17, 2007 has been disclaimed.

[21] Appl. No.: 239,350

[22] Filed: Sep. 1, 1988

Related U.S. Application Data

[63] Continuation-in-part of Ser. No. 46,713, May 7, 1986, abandoned.

[51] Int. Cl.[5] ..... B01F 7/24

[52] U.S. Cl. ..... 416/201 A; 416/178; 416/187; 366/265

[58] Field of Search ..... 416/201 A, 178, 187, 416/186 R, 199, 200 R, 197 R, 243 A, 243 R; 366/265, 263, 264

[56] References Cited

U.S. PATENT DOCUMENTS

| | | | |
|---|---|---|---|
| Re. 32,324 | 1/1987 | Kedem | 366/265 |
| 589,946 | 9/1897 | Grunow | 416/186 R |
| 742,522 | 10/1903 | Timayenis | 416/178 X |
| 949,150 | 2/1910 | Kestner | 416/201 A X |
| 1,005,767 | 10/1911 | Bickerstaff | 416/178 X |
| 1,165,931 | 12/1915 | Akimoff | 416/187 |
| 1,321,378 | 11/1919 | Kohn | 416/188 |
| 1,568,946 | 1/1926 | Generich | 416/178 X |
| 2,161,631 | 6/1939 | McFarland | 416/200 |

FOREIGN PATENT DOCUMENTS

| | | | |
|---|---|---|---|
| 1196567 | 11/1959 | France | 366/265 |
| 31105 | 10/1933 | Netherlands | 416/197 A |
| 819029 | 8/1959 | United Kingdom | 366/265 |

*Primary Examiner*—Everette A. Powell, Jr.

[57] ABSTRACT

The present invention provides a mixing impeller including a plurality of blades circumferentially mounted to a frame around the mixing impeller with adjacent blades being opened from one another. The blades are secured to the frame in a manner such that at least part of each blade extends outwardly of the frame to guide discharge of fluid passing through the impeller away from the frame and substantially eliminate any turbulence that the frame might otherwise create. In addition, the frame has a rearwardly inwardly tapering configuration with each of the blades having the same inward rearward taper as that of the frame. This combination of features substantially reduces turbulance of the outward flow of liquid from the impeller relative to conventional impeller designs.

3 Claims, 4 Drawing Sheets

SPIDER MOUNTED CENTRIFUGAL MIXING IMPELLER

This application is a continuation in part of U.S. patent application Ser. No. 07/046,713, filed May 7, 1986, now abandoned.

FIELD OF THE INVENTION

The present invention relates to a mixing impeller particularly suited for the destratification of fluids and solid-fluid suspension and having a rearwardly contracting preferably conical configuration for providing a faster and highly efficient purging circulatory flow within a mixing reservoir while producing a high volumetric flow output at low torque values.

The present invention also operates in such a manner as to produce lower pressure differentials between the blade face and blade back reducing cavitation and reducing noise at the mixing impeller as well as noise otherwise radiating from the mixing unit as a result of vibration caused by cavitation.

BACKGROUND OF THE INVENTION

Fluid mixing is vital to most production systems in the chemical process and allied industries. It has extreme importance in the mining, food petroleum, chemicals, pharmaceuticals, pulp and paper, and power industries, and in municipal and industrial waste treatment facilities.

In an axial-flow mixing impeller a flow is generated parallel to the mixing impeller shaft, along the impeller axis. Axial-flow impellers generally generate more fluid flow per horsepower than radial impellers.

A significant drawback resulting from the use of a conventional mixing impeller is the low efficiencies of the device when run at higher speeds to decrease mixing time. A general value for efficiency may be between 0.3% to 1.1%, while at lower speeds may increase to as high as 7.0%. This efficiency value is a reflection of how much power is consumed per unit of volume mixed. The less power consumed to mix a given volume of fluid, the more efficient the device.

Two of the most significant factors that affect the overall efficiency of a mixing device is the production of a strong, purging circulatory flow within a mixing reservoir and the pressure differential between the back and the face of the blade which on a conventional impeller have a foil-like construction rotated in a narrow plane resulting in very significant pressure differentials between the face and the back of the blade.

SUMMARY OF THE PRESENT INVENTION

The present invention provides an impeller designed to produce a strong purging circulatory flow within a mixing reservoir with minimal turbulence at the point of interaction between the impeller and the liquid in the reservoir. This is accomplished by constructing the impeller of the present invention using a plurality of blades circumferentially mounted to a frame around the impeller with adjacent blades being opened from one another. Each of the blades is secured to the frame in a manner such that at least part of each blade extends outwardly from the frame. This results in the discharge of the liquid from the impeller being directed away from the frame. In addition, the frame is formed with a rearwardly contracting taper with each of the blades having the same rearwardly contracting taper as that of but being opened relative to the frame to again minimize turbulence and maximize efficienty of the impeller.

BRIEF DESCRIPTION OF THE DRAWINGS

Detailed features of the present invention will be described according to the preferred embodiments of the present invention in which.

DETAILED DESCRIPTION ACCORDING TO THE PREFERRED EMBODIMENTS OF THE PRESENT INVENTION

Figure 1:
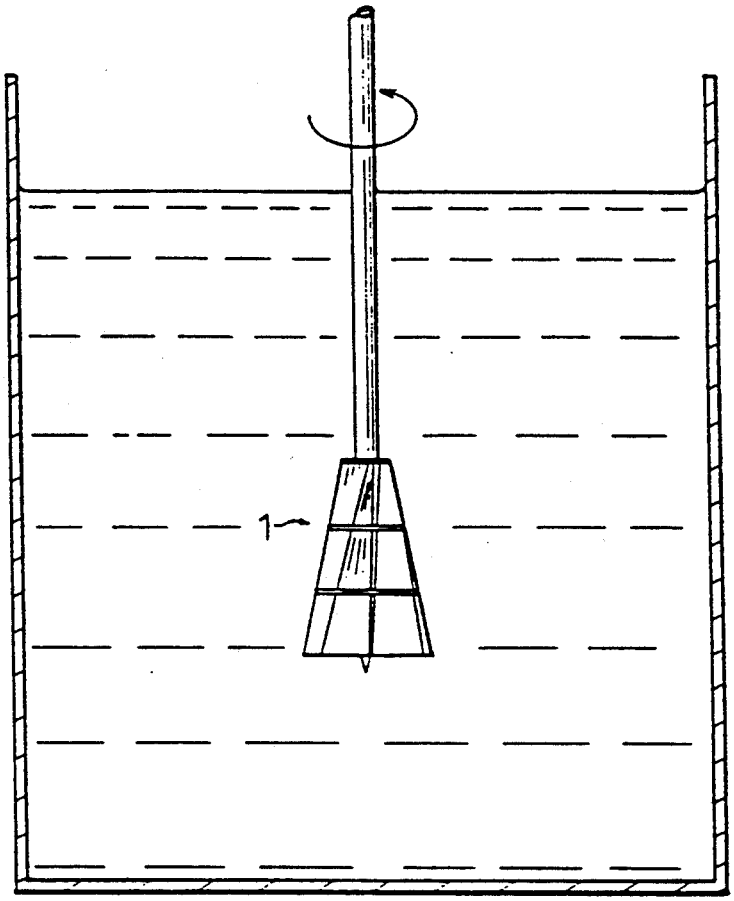
FIG. 1 is a plan view showing a general schematic embodiment of the present invention as it would be used to mix fluids.
Figure 8:
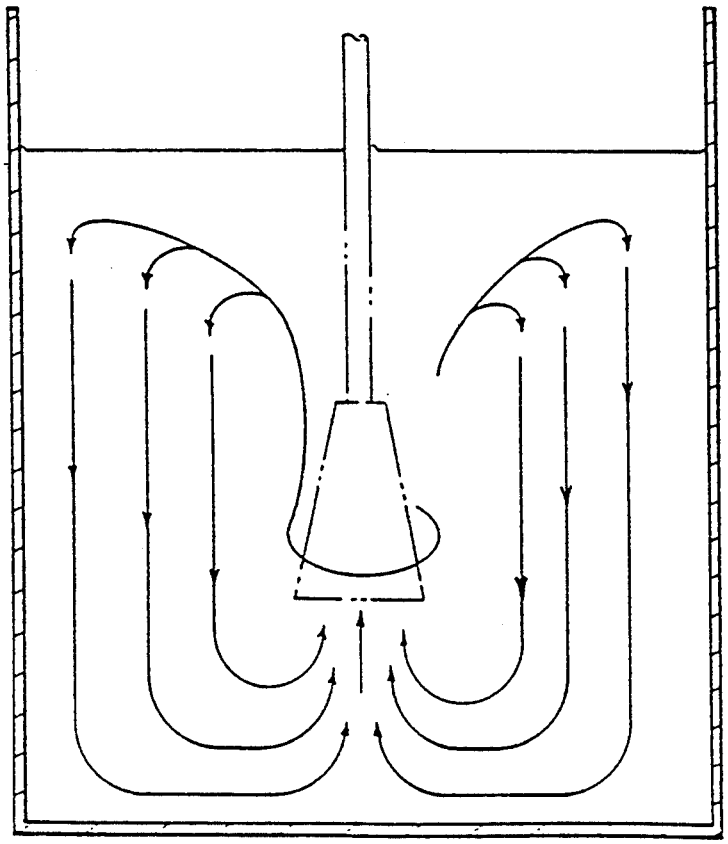
FIG. 8 is a flow diagram of the fluid inflow and outflow produced by rotation of the mixing impeller of FIG. 2.

FIG. 1 shows a mixing impeller indicated at 1 mounted in a mixing reservoir beneath the surface of the fluid to be mixed. As will be clearly seen in FIG. 1, the mixing impeller has a generally conical rearwardly contracting configuration, the details of which are well shown in FIG. 2.

The overall mixing impeller comprises a supporting frame including open ring-like support portions 2B, 2C and 2D as well as a rearwardly positioned flat closed plate-like support portion 2A. Located along the length of the mixing impeller are a plurality of blades fixedly secured in position with respect to the supporting frame. These blades according to the preferred embodiments shown in the drawings are arranged in three separate stages or groupings indicated at rearward stage 4 intermediate stage 10 and forward stage 16.

The rearward stage comprises a plurality of blades 5, the intermediate stage comprises a plurality of blades 11 and the forward stage comprises a plurality of blades 17. All of these blades are mounted to the frame opened outwardly from the adjacent blade in each stage, but if closed upon one another to a 0 degree angle, would form a closed non-overlapping conical configuration, or at least a frustrum of a cone. It is to be noted that all of the blades in the mixing impeller extend in a generally horizontal orientation and are slightly turned along their lengths as will be described later in detail.

Figure 2:
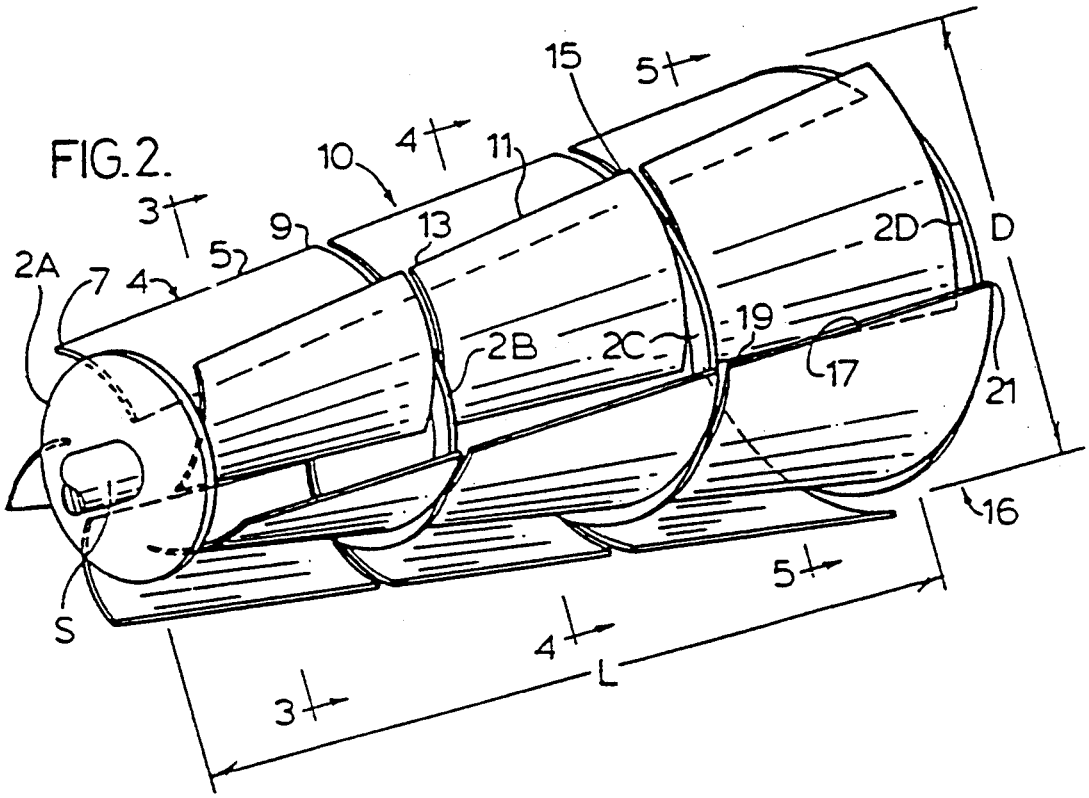
FIG. 2 is a perspective view of the mixing impeller from FIG. 1.

As best seen in FIG. 2 of the drawings, each of the blades is secured at its mid point in an opened position relative to the frame. For example, in the most rearward blade stage, each of the blades 5 is secured at the mid point of its forward end to ring-like frame portion 2B and at the mid point of its rearward end to the plate-like frame portion 2A. In the intermediate blade stage, each of the blades 11 is secured at its mid point between the two ring-like frame portions 2B and 2C and in the most forward blade stage, each of the blades 17 is secured at its mid point between the two ring-like frame portions 2C and 2D. Accordingly, in each of the stages the blades are mounted in a manner such that half of the blade extends to the inside of the frame and half of the blade extends to the outside of the frame. In this preferred embodiment there is balanced load on each blade to opposite sides of the connection points relative to the frame substantially enhancing durability of the impeller.

Furthermore, in each of the stages the outer or discharge end of the blades is clearly to the outside of the frame so that the frame itself does not create turbulence relative to the impeller discharge.

As a further feature, each of the blades has a rearward inward taper matching that of the frame. Accordingly, as the impeller operates it draws the fluid through the enlarged intake end of the impeller and because of the rearward tapering on both the frame and the blades causes the fluid to be discharged in a direction which is outwardly away from the frame which is tapering inwardly relative to that discharge. This feature in combination with the outward extension of the blades relative to the frame substantially reduces turbulence of the discharge relative to a conventional impeller design.

Still a further benefit achieved by the center mounting of each of the blades, is the reduction in frame size and weight required to properly support each of the blades since as noted above, there is a load balance to each side of that center mount. This frame reduction, relative to a conventional design again helps to reduce turbulence created by the impeller.

The incorporation of the solid end plate 2A eliminates any type of a flow through propeller effect that would once again increase turbulence on the structure. The use the solid but flat end plate must be accompanied by the outward extension of the blades relative to the frame and in particular the end plate which would otherwise result in a stall effect by back pressure created at the end plate. However, because of both the rearward inward tapering of the structure and the extension of the blades outwardly relative to the end plate this stalling effect is avoided since the fluid discharge is directed at a rearward outward angle away from the impeller.

According to conventional construction, the diameter of a mixing impeller is readily determined as the outer circumference around the individual blades on the mixing impeller. According to the present invention, the diameter of the conical mixing impeller is determined as the effective or maximum diameter at the front end of the mixing impeller.

The value of Q (volumetric outflow rate) produced by the conical mixing impeller as shown in the drawings is increased by increasing the ratio L/D with L being the length of the mixing impeller and D being the effective diameter of the mixing impeller as shown in FIG. 2.

With the conical configuration, L increases at a faster rate than D along the length of the mixing impeller. This provides a high value of blade surface area relative to the effective diameter enabling large volumes of fluid to be moved at relatively low rotational speeds.

This feature, according to the present invention, substantially increases the amount of fluid expelled by the device and in turn uses much less energy to do so. Torque values on the drive shaft of the device and the mixing impeller itself are substantially reduced as a result of this type of conical configuration, producing a much lower Power Number value given by the equation:

$$N_p = \frac{1.523 \cdot 10^{13} P}{N^3 D_p^5}$$

where

P=impeller horsepower

N=impeller speed, rpm

D=impeller diameter, in.

p=fluid viscosity, cP

Due to the lower pressure differential between the blade face and the blade back while the device is rotating, the advent of cavitation is less likely to occur if at all. This would occur in conventional mixing impellers at higher rotational speeds. In terms of equations this can be seen as:

$$p = p1 - p2$$

where p1=pressure on blade face p2=pressure on blade back

The reactionary thrust that is exerted on a fluid by an impeller is shown in the following general and accepted equation.

$$T = p * A$$

where

T=thrust

A=area of rotating body

As a result of these parameters and the unique configuration of the mixing impeller, a strong axial inflow is generated as well as a strong purging circulatory outflow necessary in an efficient mixing impeller.

Returning to the drawings, the mixing impeller itself includes a shaft S, generally central of the impeller. In the arrangement shown in the drawings, rearward support portion 2A is centrally apertured to allow fitting of the shaft which extends completely through the impeller to the forward support portion 2D, including a further centrally located securing portion for stabilizing of the mixing impeller as it is rotated by the shaft.

Figure 7:
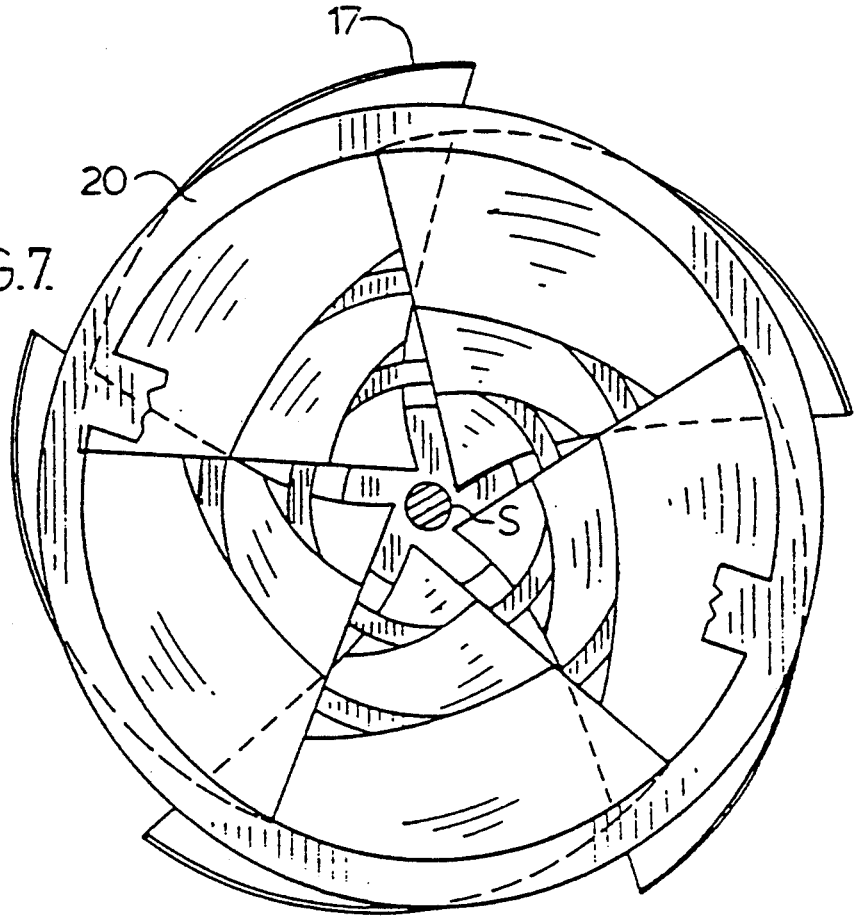

As the mixing impeller is rotated, fluid is taken in by the substantially open forward end as shown in FIG. 7, the individual blades scoop the fluid from the inside of the impeller and force the fluid out and upwardly of the openings between the circumferentially attached blades. The fluid is replaced internally from the outside of the mixing impeller through the open forward end due to the subsequent low pressure field generated internally as a result of the rotation of the impeller, producing a constant flow of fluid. The inflow has an axial as well as radial velocity due to forced vortex production from the rotation of the device. The flow is highly controlled due to its being controlled over an extended period and a substantial distance as determined by the overall length of the mixing impeller. This results in an efficient transfer of energy.

In the preferred embodiment the device is situated close to the bottom of the mixing reservoir, fluid taken from the bottom of the reservoir is replaced by fluid at the top of the reservoir by means of the forced circulation caused by rotation of the device. This circulatory circuit of fluid has substantial energy necessary for the effective mixing of solid-fluid suspension or the destratification of fluids. The energy within said circulatory circuit will break any interface that exists between the fluids to be mixed at a substantially faster rate than conventional systems used in the mixing industry.

Another feature of the present invention, when run at high rotational speeds, if such speed is required, is that all of the blade surface area is peripheral to the accelerated flow, thereby eliminating any central cavitation within the fluid flow generated by the mixing impeller.

Such cavitation may develop in an in-line mixing operation.

Such stated benefits make the device ideal for use as a mixer in mining, food petroleum, chemical, pharmaceutical, pulp and paper, and power generating industries as well as in municipal and industrial waste treatment facilities.

In order to enhance stable operation of the mixing impeller, it is important that the flow pattern along the length of the blade, as well as from stage to stage, have a constant velocity. This velocity is determined by two factors, namely the tip velocity of each blade at any one point and the inlet/outlet area between the blades at any one diameter. The inlet/outlet area determines the mass or amount of fluid taken in and subsequently expelled from the device.

In accordance with the conical construction, the tip velocity along the length of each blade, as well as the tip velocity for blades from one stage to the next, decreases from front to back of the mixing impeller due to its rearwardly decreasing diameter. Therefore, since tip velocity is decreasing, the blade angle increases along the length of each blade and between blades of different stages from front to rear of the mixing impeller.

Figure 3:
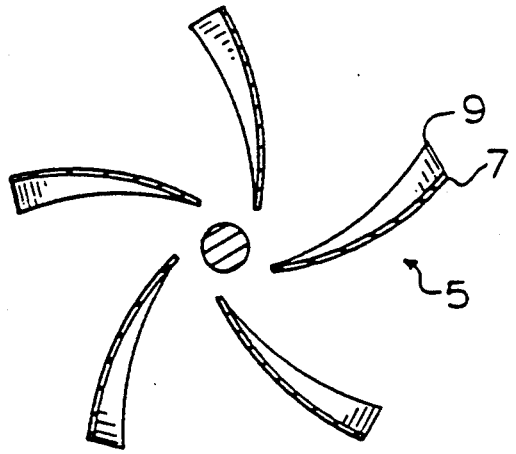
FIGS. 3 through 5 are sectional views along the lines 3—3, 4—4, 5—5 respectively of FIG. 2.
Figure 4:
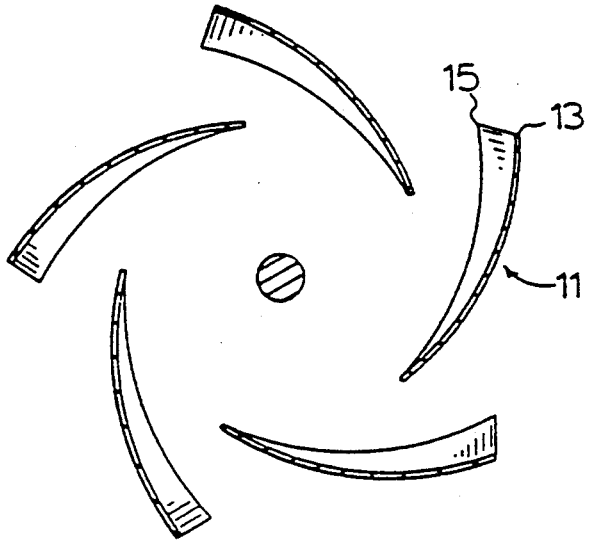
Figure 5:
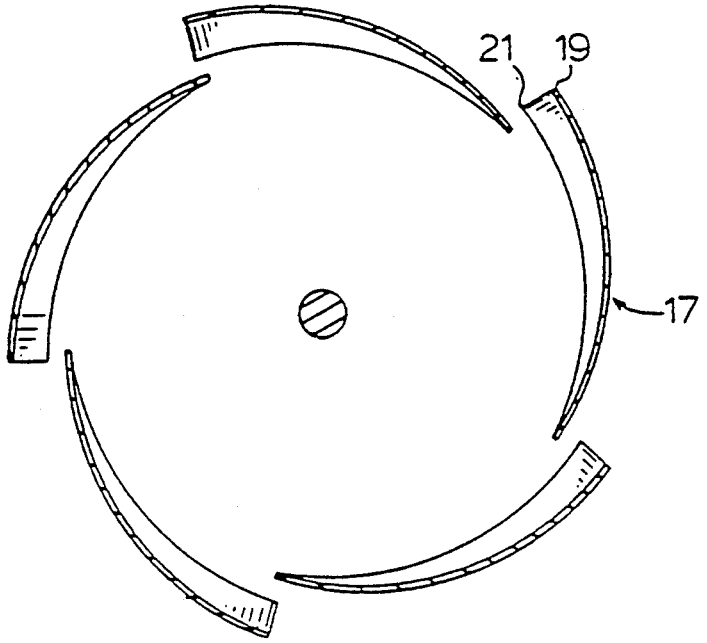
Figure 6:
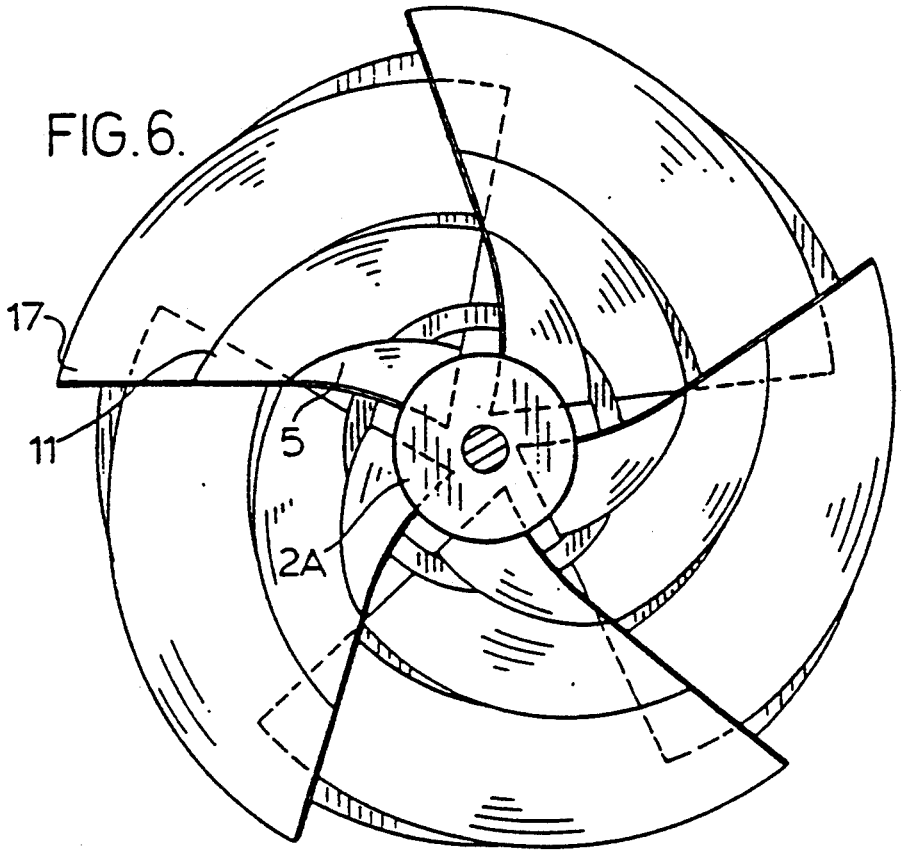
FIGS. 6 and 7 are rear and front views respectively of the mixing impeller of FIG. 2.

Referring to FIGS. 2 through 5, it will be seen that blades 5 in third stage 4 have first and second ends 7 and 9 respectively; blades 11 in second stage 10 have first and second ends 13 and 15 respectively; and blades 17 in first stage 16 have first and second ends 19 and 21 respectively. Each of the blades have a reduced blade angle between its first and second ends. In FIG. 3, it will be seen that blade 5 has a reduced angle from its first end 7 to its second end 9; in FIG. 4 it will be seen that blade 11 has a reduced blade angle from its first end 13 to its second end 15; and in FIG. 5 it will be seen that blade 17 has a reduced blade angle from its first end 19 to its second end 21.

Furthermore, it will be clearly seen in FIGS. 3 through 6 that the inlet between blades is reduced from the third rearward through to the first forward stage. In FIG. 3 the gap or inlet between blades 5 is increased relative to the gap or inlet between blades 11, shown in FIG. 4, which in turn is greater than the gap or inlet between blades 17, shown in FIG. 5.

From the above, it will be clearly seen that the blade angles are greater at the smaller diameter end of the mixing impeller than they are at the larger diameter end of the mixing impeller with the difference in the blade angles being determined according to the diameter of the mixing impeller.

As the impeller shown in the drawings rotates within the fluid contained in a mixing reservoir, the blades are subject to different fluid densities at different fluid depths or pressures, depending on the axial plane that the mixing impeller is rotated upon. In order to maintain blade stability, each of the blades may be cambered to compensate for any appreciable density differences within the fluid.

The number of blades, five of which are shown in the drawings, in each stage is a function of the load and output requirements of the mixing device, as well as the structural and space limitations in a mixing reservoir. Similarly, the number of stages affect the flow characteristics and the structural requirements of the mixing impeller.

As a result of its efficient operation, the mixing impeller of the present invention produces substantially less friction and thermal energy than found in conventional mixing impellers. This in turn results in less wear on the impeller which can therefore be made from less expensive materials, than has been possible in the past.

Furthermore, due to the lower pressure differentials that exist between the blade face and back, the mixing impeller of the present invention will produce a corresponding reduction in generated noise and vibration that can be transmitted to equipment attached to the said mixing impeller.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A mixing impeller comprising a plurality of blades circumferentially mounted around a frame with adjacent blades being open from one another, each of said blades having a forward intake end and a rearward discharge end and being tapered such that said forward intake end is enlarged relative to said rearward discharge end and said blades being turned along the length thereof from said forward intake end to said rearward discharge end to cause an outward flow of fluid along said blades, said frame also being rearwardly tapered such that fluid taken in at the forward intake end of said blades is discharged outwardly away from said frame at said rearward discharge end of said blades.

2. A mixing impeller as claimed in claim 1, wherein each blade has a mid point connection to said frame such that equal portions of said blades extend inwardly and outwardly of said frame.

3. A mixing impeller as claimed in claim 1, wherein said frame comprises at least one forward open ring-like frame portion and a rearward flat plate frame portion between which said blades are secured.

* * * * *